US007836736B2

(12) United States Patent
Humphris

(10) Patent No.: US 7,836,736 B2
(45) Date of Patent: Nov. 23, 2010

(54) LOCK MECHANISM

(75) Inventor: Keith Humphris, Maldon (GB)

(73) Assignee: Sure Locking Systems Limited (GB)

( * ) Notice: Subject to any disclaimer, the term of this patent is extended or adjusted under 35 U.S.C. 154(b) by 394 days.

(21) Appl. No.: 11/650,623

(22) Filed: Jan. 8, 2007

(65) Prior Publication Data

US 2007/0107478 A1 May 17, 2007

Related U.S. Application Data

(63) Continuation of application No. PCT/GB2005/002616, filed on Jul. 5, 2005.

(51) Int. Cl.
*E05B 65/06* (2006.01)

(52) U.S. Cl. ..... 70/101; 70/2; 292/281; 292/288; 292/296

(58) Field of Classification Search ..... 70/2, 70/101; 292/281, 285, 288, 289, 296
See application file for complete search history.

(56) References Cited

U.S. PATENT DOCUMENTS

| | | | | |
|---|---|---|---|---|
| 3,973,520 A | | 8/1976 | Flocchini | |
| 4,459,832 A | * | 7/1984 | Avrea et al. | 70/14 |
| 4,576,021 A | | 3/1986 | Holden | |
| 6,546,766 B1 | * | 4/2003 | Klingler | 70/230 |
| 6,609,739 B1 | | 8/2003 | Avganim | |
| 6,848,284 B2 | * | 2/2005 | Chen | 70/56 |

FOREIGN PATENT DOCUMENTS

| | | |
|---|---|---|
| EP | 0405252 | 1/1991 |
| EP | 0632179 | 1/1995 |
| EP | 0953703 | 11/1999 |

OTHER PUBLICATIONS

International Search Report.

* cited by examiner

*Primary Examiner*—Suzanne D Barrett
(74) *Attorney, Agent, or Firm*—Renner, Kenner, Greive, Bobak, Taylor Weber

(57) ABSTRACT

A lock mechanism to lock two parts relative to each other. The lock mechanism comprises a base plate (30) attachable to one said parts with a pivot pin (26) connected thereto, a keep (38) being defined in the pivot pin. A lock body (24) is also provided and this defines a channel (33) within which the pivot pin locates for rotation of the lock body relative to the pivot pin. A locking arrangement (36) is located within the lock body, and includes a movable bolt (37), which in extended and retracted positions engages with or disengages from the keep (38) to prevent or allow rotation of the lock body relative to the pivot pin. A latch plate (40) may be provided on the other part to cooperate with the lock body. This allows a wide variety of different parts to be secured relative to each other in such a way that they are securely held.

16 Claims, 10 Drawing Sheets

LOCK MECHANISM

CROSS REFERENCE TO RELATED APPLICATIONS

This application is a continuation of International Patent Application No. PCT/GB2005/02616, filed Jul. 5, 2005.

The present invention relates to a lock mechanism and in particular a lock mechanism for relative locking of a first part and second parts with which the lock mechanism is associated.

Many existing lock mechanisms for locking parts relative to each other are known and these are intended for a wide variety of different uses. The present invention however is primarily concerned with lock mechanisms that can be fitted on to the outside of existing structures, with little or no modification of those structures, in order to prevent the unauthorised opening/movement of those structures. It does also in certain embodiments relate to a mechanism that can be formed as part of the construction of a hinge, which would advantageously be incorporated at construction.

Of the types of lock available, which may be fitted to existing structures, for the relative locking of a first part and a second part, these predominantly comprise simple "hasp and staple" arrangements or sliding bolts. These arrangements are popular because they may be easily mounted, and both may be fixed in place by the use of a separate padlock. In most cases the parts to be fitted together using these types of mechanism, and indeed the mechanism of the present invention, are doors moving relative to a frame, or doors moving relative to another door. The two parts may also be lids of boxes and the like which are opened away from the remainder of the box which would constitute the second part. In all cases the purpose of the lock is to prevent the unauthorised opening or other movement of the one part relative to the other part. For example, in the case of a door, a lock mechanism might be provided to prevent the movement of that door away from its closed position therefore ensuring that unauthorised access is not permitted.

The use of "hasp and staple" locks, sliding bolts and indeed other similar types, suffer from several disadvantages. The first and most significant of these disadvantages is that their ability to resist tampering depends upon the padlock. However, most padlocks are relatively easily levered or cut open using bolt cutters, thus rendering the entire lock mechanism useless. Furthermore, the nature of existing mechanisms leads the mechanisms themselves to be susceptible to attack by levering or cutting, or from someone able to access whatever means are used to fix the lock to the doors (such as screws) and thereby circumvent the locking effect simply by either unscrewing the device or by prising it from the door. Finally, such types of prior lock are not usually easily adaptable to fit to different arrangements parts, as they tend to be limited to preventing one or a few types of relative movement.

It is therefore an aim of the present invention to provide a different concept in locking, and further provide a type of lock which either totally removes or significantly reduces the drawbacks of the prior art. Specifically, the invention aims to provide a lock which is significantly less susceptible to attack by leverage or by cutting with bolt cutters or the like. It also aims to provide a mechanism which is able to be fixed by conventional means to an existing structure but when locked can prevent access to those fixings and therefore removal of the lock mechanism. It is a further aim of the present invention to provide a device that is adaptable in terms of its ability to lock a range of different components that move differently with respect to each other; unlike the prior art which often requires particular adaptation to a particular situation.

Therefore, according to the present invention there is provided a lock mechanism to lock a first part and a second part relative to each other, said lock mechanism having a locked configuration and a open configuration, and said lock mechanism comprising: a base plate attachable to the first part; a pivot pin; a keep defined in the pivot pin; a lock body defining a channel within which the pivot pin is located such that rotation of the lock body relative to the pivot pin is permitted when in the open configuration; and, a locking arrangement, located within the lock body, and including a bolt, which bolt is movable by the locking arrangement between an extended position and a retracted position, whereby in the locked configuration the lock body and pivot pin are suitable positioned relative to each other such that the bolt may be moved by the locking arrangement to the extended position and thus prevent rotation of the lock body relative to the pivot pin.

The lock body may be defined and constructed in many different forms, however it has been found highly preferable that it generally has a D-shaped or semi-circular profile. Such profiles have a substantially straight side and preferably the axis of rotation of the pivot pin would be adjacent this, and the remainder of the lock body including the curved external edge would extend to one side thereof. The clearance between the lock body and base plate would be as small as possible, to minimise potential for placement of a lever. However in some embodiments, discussed below, a gap sufficient to allow the passage of a latch plate is desirable, which gap would tend to be substantially filled by the second when in the closed configuration. The curved external edge of the lock body also substantially reduces the possibility of leverage being applied, or the effectiveness of that lever.

It is preferred that the channel in the lock body is defined by a tubular sleeve which is located substantially to one side of the lock body, and having an internal diameter suitable to snugly receive the pivot pin, with the remainder of the lock body extending laterally to one side with respect to the sleeve. The sleeve would in such circumstances have an aperture formed therein in order that the bolt of the locking arrangement is able to move through the sleeve for engagement with the keep in the pivot pin.

As mentioned, the lock body preferably is generally D-shaped in profile, and this may be formed by the sleeve defining the straight edge and a curved bar defining the curved portion of the D-shape. Both ends of the curved bar would be joined to (or integrally formed with) spaced parts of the sleeve. Such a D-shaped composite lock body might be formed from metal tubes, or the curved bar might itself be solid, dependant on weight and strength characteristics. The space defined by the sleeve and curved edge may be covered on one side by a front cover plate attached thereto (or integrally formed therewith). Similarly, a rear cover plate may be arranged on the opposed face so that they enclose the space and together define a lock chamber. The locking arrangement will preferably be located within this protective chamber and thus tampering or malicious damage to this weak part of the overall mechanism is prevented. Access to the lock arrangement for a key or other actuator is provided through a keyhole or other suitable opening in the front or rear plate.

The lock body may be formed from several discrete parts, such as the sleeve, curved bar, and front and rear plates that are joined together during construction. However, the lock body may also be partially or wholly formed from a single piece defining several or all of those parts. Such a piece could take the form of a one piece moulding defining the sleeve, curved edge bar and front plate. Such a piece would define a suitable recess within which the lock arrangement could be mounted and provide access for travel of the bolt into the channel defined. Once a lock arrangement had been inserted it could be covered by a separate rear plate attached to the remainder of the lock body. Obviously, in such a one piece moulding a sleeve would technically not comprise a sleeve but would instead be a channel or bore formed through the solid material of the lock body, but the functionality would be the same. Indeed, when considering the pivot it need only allow rotation and locking of the lock body relative to the base plate. Any arrangement of pivot, base plate and lock body that permits this is within the scope of the invention.

The configuration of the base plate will depend upon, in certain circumstances, the particular adaptation of the lock mechanism. However, in many situations the base plate will preferably be adapted to locate on the edge of a first part to be locked, in particular as a second part to be locked is liable to be brought into close proximity with that edge in the locked position. Therefore, it is preferred that the base plate has two regions, which are substantially at a right angle to each other such that the first of those regions will locate on one face of the first part and the second region locates against a second adjacent face of the first part. Often in such a configuration the second face of the first part will be concealed by the second part when in a closed configuration, and consequently sufficient space must be available (or formed) between the first and second parts in the closed configuration for that part of the base plate to be located there.

In certain embodiments, discussed in more detail below, it is desirable for the pivot pin to be able also to slide with respect to the pivot pin as well as simply rotating. However, for most embodiments sliding is both unnecessary and in some undesirable. It is therefore preferred that the pivot pin is fixed rigidly to the base plate and cannot move with respect thereto. Such a lack of movement includes no rotation of the pivot pin relative to the base plate. Further, it is preferred that the base plate has two upstanding portions between which the pivot pin is mounted spaced from the base plate. The pivot pin is preferably mounted between these substantially parallel to the base plate (and usually the surface of the first part on which it is mounted) such that in practice it is the lock body which pivots around the pivot pin with respect to both the base plate and the first part.

Preferably the length of the pivot pin between the upstanding portions on the base plate is only marginally longer than the channel defined in the lock body. In this way the upstanding portions are close to or abut substantially against the ends of the channel and prevent access to the pivot pin. The pivot pin is also preferably a continuous length extending all the way through the channel, but the pivot may be in one or more part as long as the lock body can still be locked for movement with respect to these.

In a simple form, the present invention can be used to form an obstruction preventing the movement of the second part relative to the first part. For example, if the base plate is fixed to the frame of a door, the lock body may be moved to a locked configuration whereat it overlies the door (being the second part). In this way movement of the door toward the lock body is obstructed thereby, and assuming the door by its construction is only able to open in that direction, opening of that door is thereby prevented. Such an arrangement however is only appropriate in terms of a door or other second part which moves substantially out of the plane of the first part, in a single direction. This arrangement would not function for a door that was able to open in both directions or which slid laterally away from the first part. Also, if the present invention is being used to lock the lid on to a chest, the effective movement of the lid is equivalent to a lateral sliding, at least in respect of the movement near its closed position. Consequently, again such a simple embodiment of the present invention would be inappropriate, unless the lock body engaged with a formation on the second part.

Such a formation might be a simple recess into which a projection on the lock body located, but this would only function for lateral movement. Therefore it is preferred that a separate latch plate is also provided, which latch plate is designed for fixing to the second part and which will be brought into contact with the base plate and/or lock body when the two parts are in a closed configuration. The latch plate will be adapted such that it may be held at that closed position by the movement of the lock body to the locked configuration and relative movement of the second part in any direction will be prevented unless the lock body is open.

It is preferred that the lock body is provided with one or more pegs which locate within co-operating female parts in the base plate when the lock body is in the closed configuration. The rotational movement of the lock body relative to the base plate would engage the or each peg into the or each female part. It is also possible for the or each peg to be provided upstanding from the base plate and the female part to be provided on a rear (when in the locked configuration) face of the lock body. However, for convenience, herein a description of only of the first possibility will be followed, but the second is specifically also included within the scope of this invention. The engagement of such pegs and female parts can be used to improve the structural rigidity of the overall lock mechanism when in a closed configuration. However, their main purpose is to provide a mechanism for the selective engagement of the latch plate with the base plate. The latch plate is preferably provided with a hole corresponding to each peg, and when the latch plate is brought into its position relative to the base plate the movement of the lock body will pass each peg through each hole and into each female part. This will thereby prevent removal of the latch plate and relative movement of the second part until such time as the lock body is opened and the pegs removed from the holes therein.

Movement of the latch plate in to contact with the base plate may be a linear movement in the plane of the base plate such that the latch plate is parallel to and slides over part of the base plate. Given this it is preferred that the pegs are located on the lock body as provision of the pegs on the base plate might interfere with movement of the latch plate relative to the base plate. Such linear movement may be from either side of the pivot. The movement may also be from out of the plane of the base plate, such as vertically from above.

The locking arrangement of the present invention may take any suitable form as long as it is able to securely control the movement of the bolt into and out of engagement with the keep in the pivot pin. A simple conventional mortise lock arrangement is preferred; however any other mechanism such as a cylinder lock will also suffice. Also movement of the bolt is discussed predominantly in linear terms, but the insertion of a bolt or bolt equivalent into a keep or keep equivalent need not be linear As mentioned before, the base plate and any other parts such as the latch plate are preferably attached to their relative parts by any appropriate conventional means, such as screws, bolts, rivets or the like. It is highly preferred that the lock body will, in its closed configuration, completely cover and conceal these fixing mechanisms such that they may not be undone. Concealment of these may be achieved by positioning part of the base plate between the parts to be locked. However, any other part of the base plate (or at least any other part having the fixing means) may preferably be positioned underneath the lock body when the lock body is in its closed configuration. Furthermore, a latch plate, if present may be adapted such that it moves to a position adjacent, and possible at least partially overlying, the base plate when in the closed configuration and is thereat also covered by the lock body.

As mentioned above, the pivot pin may also be able to slide within the channel when unlocked. Engagement of the bolt within the keep in the pivot pin not only prevents rotation of the pivot pin but also prevents sliding movement with respect to the lock body. Such sliding may take the form of movement of the lock body with respect to a fixed pin and base plate, or alternatively the lock body itself may be connected to the base plate and may be used to fix the pivot pin which in the open configuration is able to both rotate and slide with respect to the base plate and the lock body. In such a sliding embodiment it is preferred that the pivot pin has a free end and that the free end is adapted to engage in a suitable formation provided on the second part, and that it may be locked at that point by engagement of the bolt within the keep. In such an arrangement the mechanism may in many respects be equivalent to a conventional sliding bolt mechanism, with the base plate equivalent to the fixed part of such a conventional arrangement. In this way the pivot pin may be slid sideways into engagement with a separate keep provided on the second part and may be locked at that position by engagement of the bolt within the lock body. Such a device, as mentioned, would be functionally equivalent to a conventional sliding bolt lock, however it would have the distinct advantage that the positioning of the bolt in the locked configuration and its locking there is not subject to the limitations of a conventional padlock which would otherwise need to be used to lock it. Such an embodiment of the present invention could also be further adapted such that it might, when unlocked, be disassembled to such a suitable degree by removal of the pivot pin, and then reassembled in opposite handed arrangement.

The lock mechanism of the present invention may also be used to lock the hinge of a door or lid such that the relative motion of the two hinged parts is prevented. In such an embodiment the base plate will be attached to or form part of the first hinged part. The lock body will be attached to or form part of a second hinged part. The pivot pin, which is fixed to the base plate will be either be coaxial with any other hinges or will replace them, such that the hinging of the first and second parts will cause relative rotation of the lock body around the pivot pin. When in the closed position the bolt within the lock arrangement can be moved into the keep in the pivot pin thus preventing any further rotation until it is unlocked by key operated retraction of the bolt from the keep.

It will be appreciated that the foregoing description outlines the major features of the present invention; however it is not to be considered wholly exhaustive and further modifications and adaptations could be performed by one skilled in the art in order to adapt the present invention to a multitude of different modes of operation, and these also fall within the scope.

The present invention also provides a modular system that with a few simple components can be adapted to operate in a variety of different ways. This means that a whole range of locking solutions can be provided for different problems by assembly of a lock from the correct selection of constituent parts.

In order that the present invention may be better understood, but by way of example only, the present invention will now be described in more detail in relation to the accompanying drawings in which.

Figure 1:
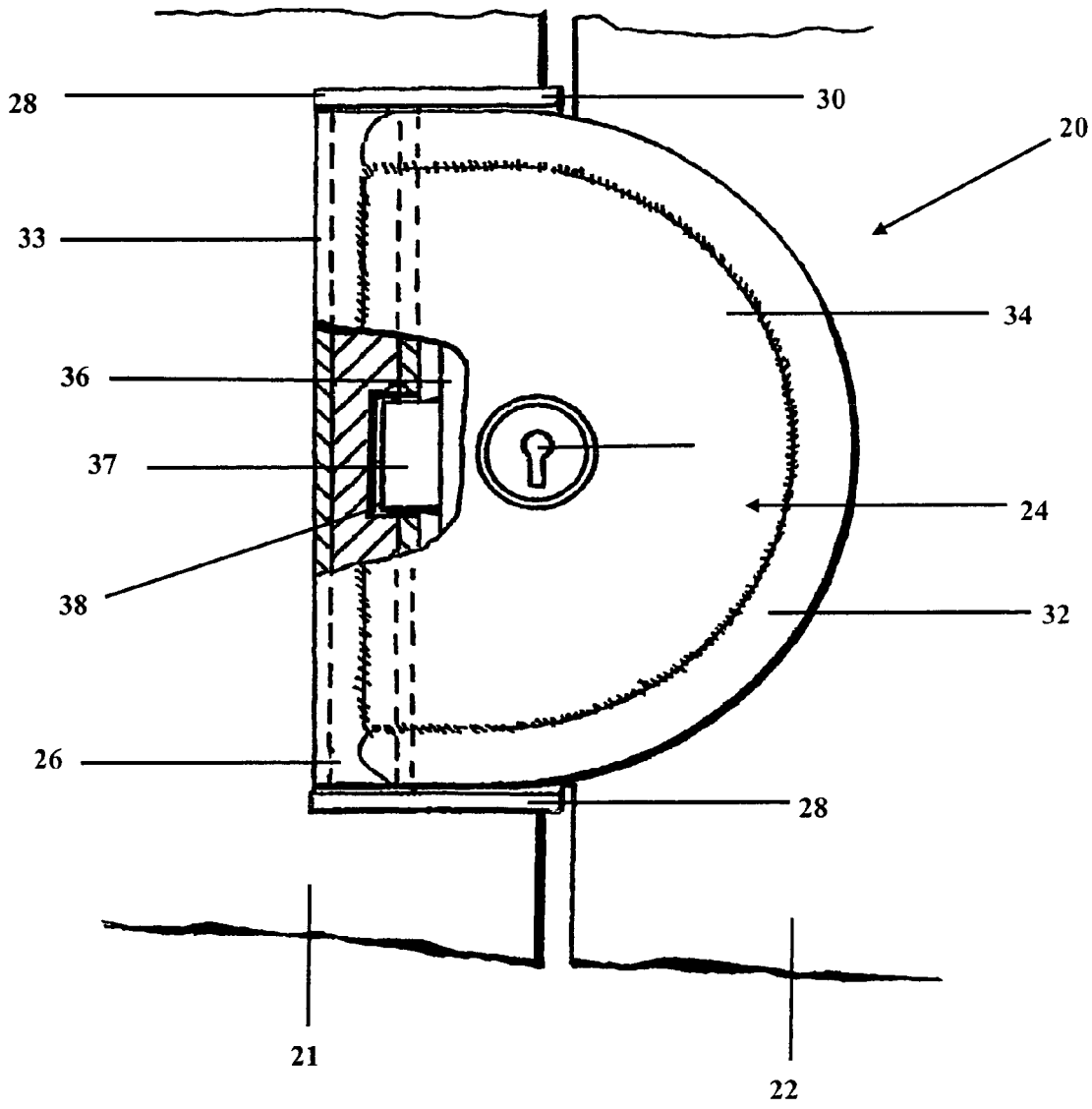
FIG. 1 is a view of a first embodiment of the present invention attached to a door and a door jamb, in a locked position with a partially cut away view of the inside thereof.

Referring initially to FIG. 1 there is shown a first embodiment of lock mechanism according to the present invention which is generally indicated 20. The main part of this is attached to a door frame (or jamb) 21 which constitutes the first part. The lock mechanism is adapted to be locked such that an adjacent door 22, being the second part, may be locked relative to the door frame 21. In this embodiment the lock mechanism includes a latch plate attached to the door, which is discussed in more detail below, but in a simple embodiment of the present invention there would be no need for such a latch plate, as the overhanging part of the lock body could form a suitable obstruction to movement out of the plane.

The lock mechanism 20 generally comprises a D-shaped lock body 24 mounted for rotational movement around a pivot pin 26. The pivot pin is fixedly mounted between two upstanding flanges 28 such that the pivot pin cannot rotate with respect to those flanges 28. The flanges 28 extend upwardly from a base plate 30 which is adapted for fixing to the door frame 21.

The lock body 24 comprises a generally curved bar 32 of circular cross-section joined to a generally straight hollow sleeve 33 within which the pivot pin 26 is located. A cover plate 34, and a similar rear cover plate (not visible) are provided on opposite faces of the curved bar 32 and the sleeve 33 in order to define a chamber therein. Mounted within the chamber is a mortise lock 36 with a laterally moving bolt 37. The bolt 37, on insertion and rotation of a key in the mortise lock 36, will slide laterally through an opening formed in the sleeve 33 and will, as long as they are aligned engage in a keep 38 formed in the pivot pin 26. The key operating mechanism of the mortise lock ensures that only the possessor of the relevant key is able to slide the bolt into or out of the keep. Access to the mortise lock via a key is provided through a keyhole 39.

Figure 2:
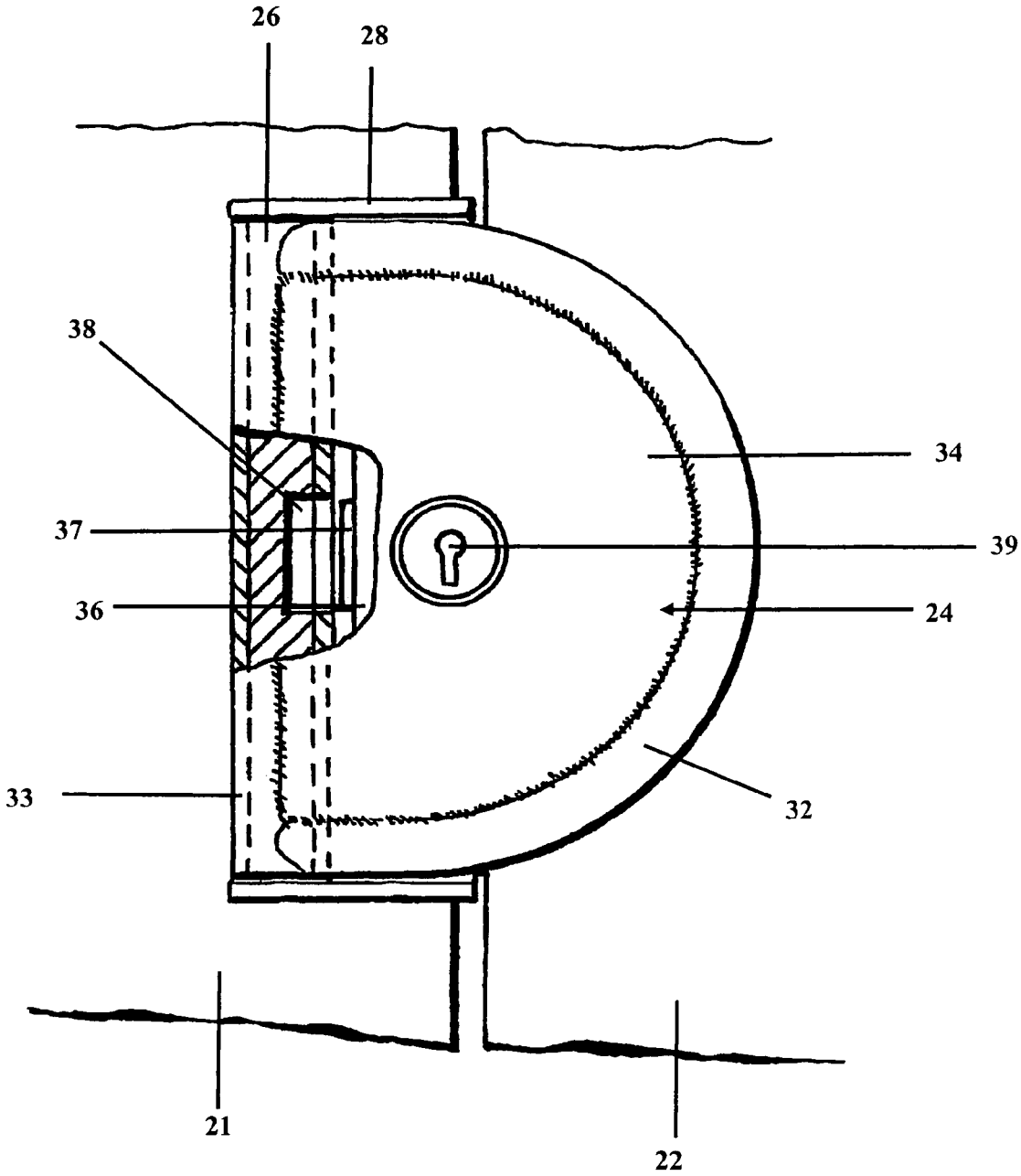
FIG. 2 is a similar view to FIG. 1 but shown unlocked and ready for movement to an open configuration.

FIG. 2 is essentially equivalent to FIG. 1 however in this Figure the bolt 37 has been retracted from the keep 38. In this view the lock body 24 is able to rotate relative to the pivot pin, unlike in FIG. 1 where rotation of the lock body 24 relative to the pivot and base plate is prevented. In the locked configuration shown in FIG. 1 the lock body 24 overlies the second part 22 and prevents its relative movement out of the plane of the drawing. Although not visible in FIGS. 1 and 2, because it is concealed by the lock body, a latch plate (shown and numbered in subsequent drawings) is provided on the door 22. This prevents relative movement of the door in other directions.

Figure 3:
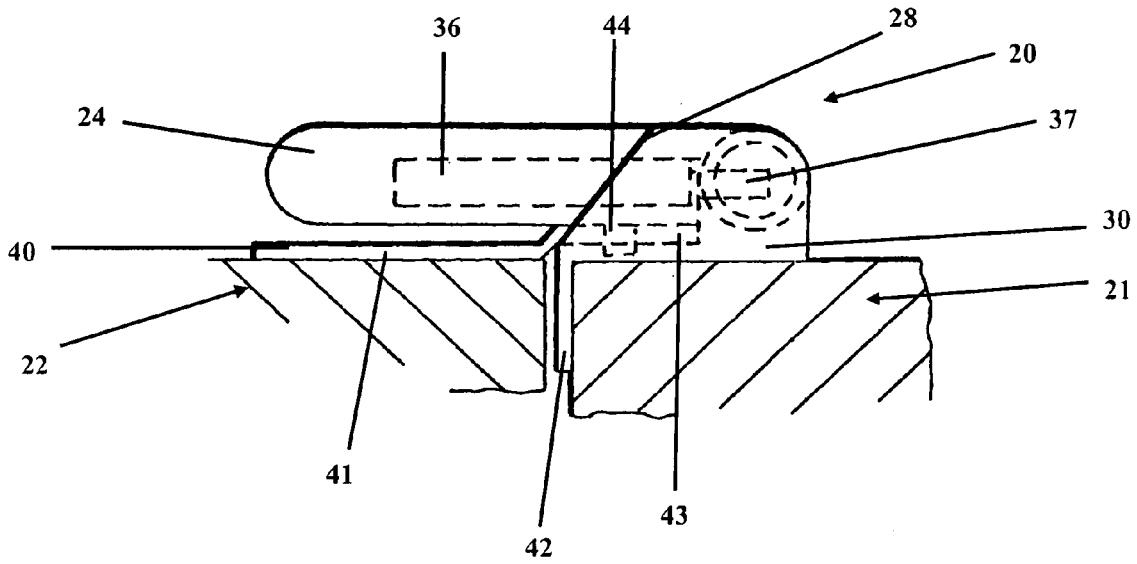
FIG. 3 is a cross-section through the embodiment of FIGS. 1 and 2 in the locked configuration.

In FIG. 3 a cross-section along approximately the centre line of the lock body is shown. In this view a generally flat latch plate 40 is visible and it is connected to the door 22 and it engages with the remainder of the lock mechanism 20 attached to the door frame 21. The latch plate has a main portion 41 that overlies and is connected to the door 22, and a free portion 43 that overhangs the edge of the door. As can be more clearly seen in FIG. 3 the base plate 30 is formed with a 900 bend such that a down-turned lip 42 is defined. This down-turned lip 42 locates around the edge of the door frame 21 and between that and the door 22. Therefore, in use it is concealed in the locked position and fixings provided therethrough into the door frame are obstructed—so cannot be removed. A projecting peg 44 is provided on the underside (as viewed when locked) of the lock body 24 and in the closed configuration this passes through apertures 52 in the free portion 43 of the latch plate 40 and into openings 46 formed in the base plate 30. Rotational movement of the lock body 24 to the closed position whereat it lies substantially parallel to and over the surface of the door 22 engages the pegs 44 through the apertures 52 and into the holes 46. When the locked configuration, as shown in FIG. 3, is achieved such that the mortise lock can be operated to engage the bolt 37 in the keep 38, rotation of the lock body 24 around the pivot pin 26 and away from the base plate is prevented. Consequently removal of the peg from the apertures 52 is prevented and thus movement of the door 22 away from the door frame 21 is prevented. Furthermore, the fact that the lock body 24 substantially overlies the latch plate 40 when in the closed position and indeed overlies that part of the base plate 30 that would otherwise be visible, ensures that these are protected from attack in the locked position.

Figure 4:
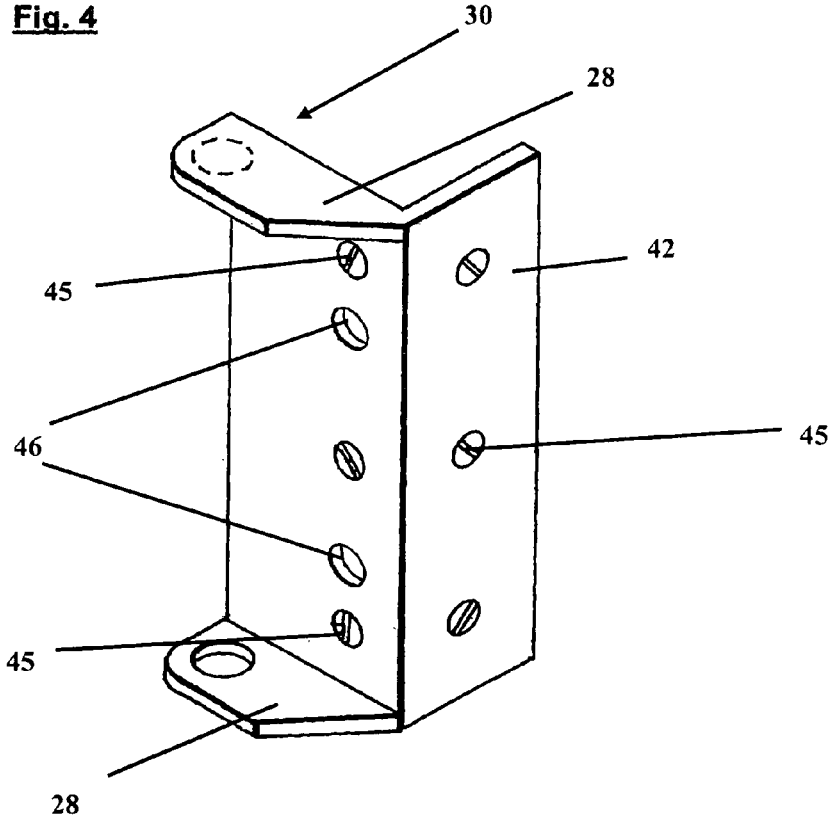
FIG. 4 shows a perspective view of the base plate of the first embodiment.

FIG. 4 shows in perspective the base plate 30 such that the upstanding flanges 28 and down-turned lip 42 are more clearly visible. As can also be seen, the base plate 30 is provided with several screw holes 45 through which conventional screws may be passed to affix the base plate to the door frame 21. In this drawing screw heads are shown in the screw holes 45. As discussed above those screw holes 45 provided on the down-turned lip will in the closed configuration be obstructed by the door and consequently it will be impossible for these to be undone without opening the door. Likewise the screw holes 45 provided on the main part of the base plate 30 would be obstructed by the lock body itself when in the closed position. However as they are not located beneath the pivot pin it is possible to reveal these screw holes 45 when in the open configuration—thus permitting authorised mounting or removal of the lock mechanism 20. FIG. 4 also clearly shows the holes 46 into which the pegs 44 will engage after passing through the apertures in the latch plate.

Figure 5A:
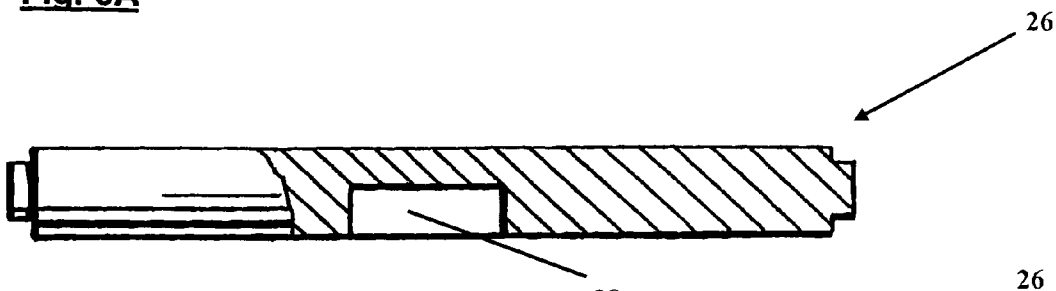
FIG. 5A shows a partial cross-sectional view of one embodiment of pivot pin.
Figure 5B:
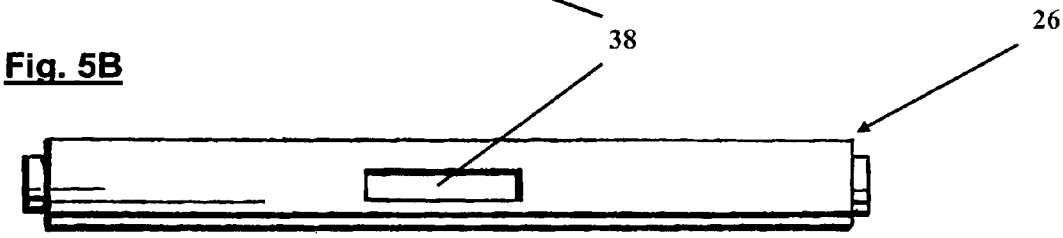
FIG. 5B shows a side view of the pivot pin of FIG. 5A.

As seen in FIG. 5A and FIG. 5B the pivot pin 26 is generally cylindrical with appropriate end formations to allow non-rotational fixed mounting between the upstanding flanges 28 of the base plate 30. A generally rectangular keep 38 is formed within the pivot pin. The shape of the keep 38 should be appropriate to receive the bolt.

Figure 6:
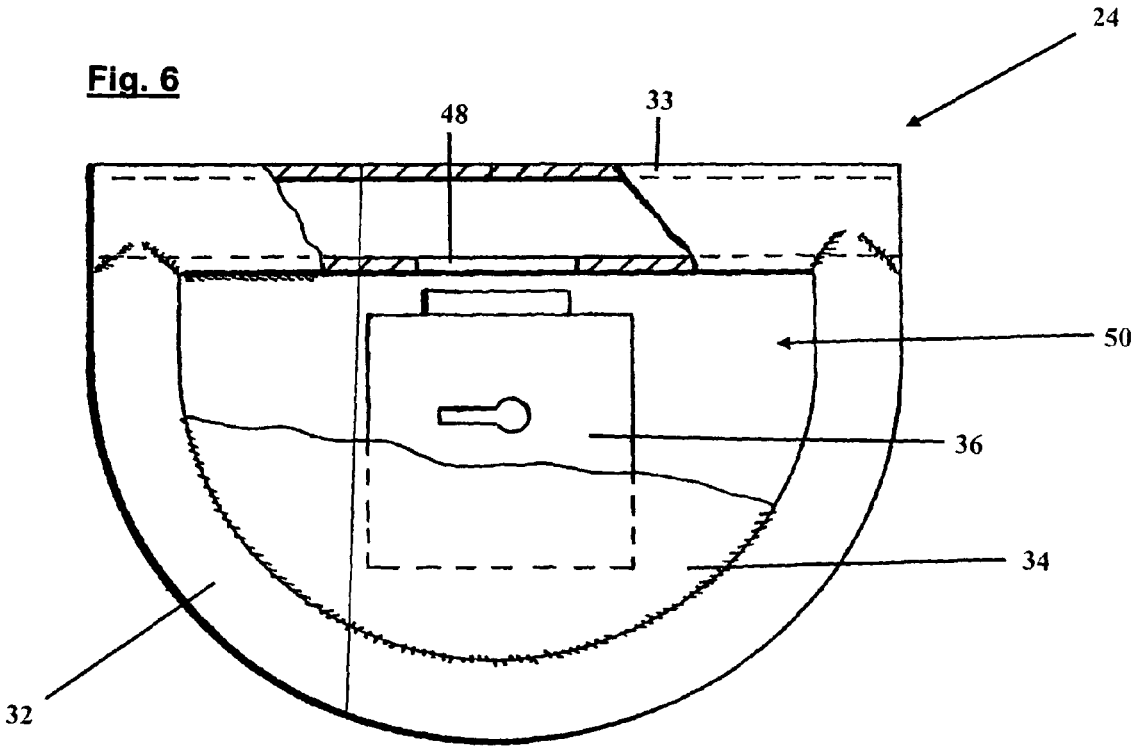
FIG. 6 shows a partially cut away view of the lock body shown in FIGS. 1 to 3.

In FIG. 6 a partially cut away view of the lock body 24 is shown. In this embodiment it can be seen that the sleeve 33 is formed from a length of metal tube defining a channel in which the pivot pin is located. The internal diameter of the channel will be sufficient that the pivot pin is freely locatable therein without excessive play. The curved bar 32 is also formed from hollow metal tube to give a lightweight yet strong design of the lock body 24, which is the part most available for attack. The use of a curved edge profile for the curved bar minimizes potential for leverage by reducing sharp corners. In this Figure the cover plate 34 has been shown partially cut away to better reveal the mortise lock 36. In this view the bolt is retracted but it would on locking be extended through an opening 48 in the sleeve to engage in the keep. The mortise lock 36 is mounted onto a rear plate 50 which together with the cover plate 34, sleeve 33 and curved bar 32 protect the mortise lock from attack, because this is the relatively weak part of the overall construction.

Figure 7:
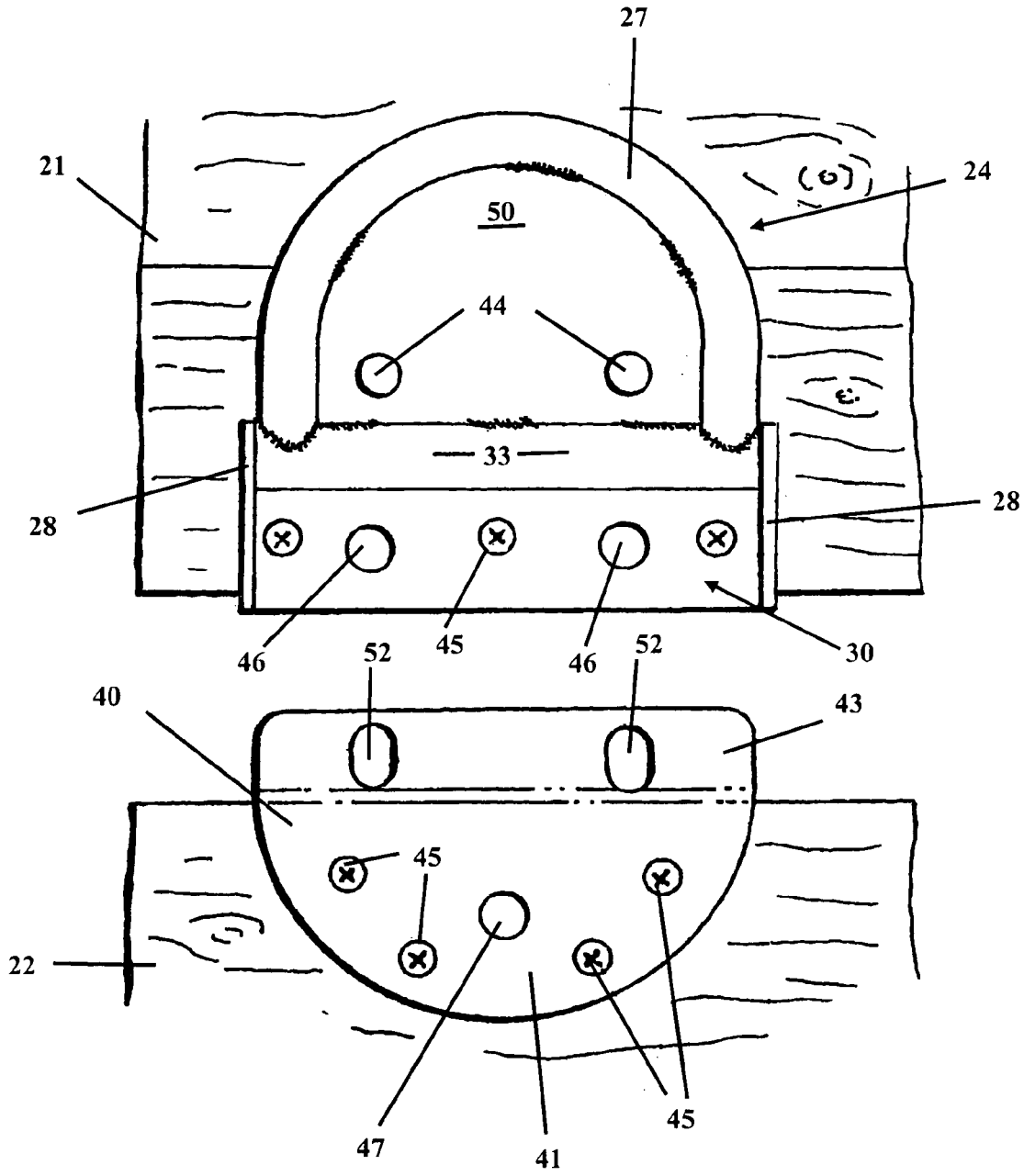
FIG. 7 shows the first embodiment of lock mechanism according to the present invention but in an open position and revealing a latch plate attached to the door.

FIG. 7 shows a view of the previously discussed embodiment of lock mechanism 20 with the main part (consisting of the base plate 30, lock body 24 and pivot pin (not visible in this drawing)) mounted on the door frame 21. The latch plate 40 is similarly connected by screws to the door 22. In FIG. 7 the lock body 24 has been moved to a totally open position and the door and door frame are shown separate such that the latch plate is not engaged with the base plate.

Figure 8:
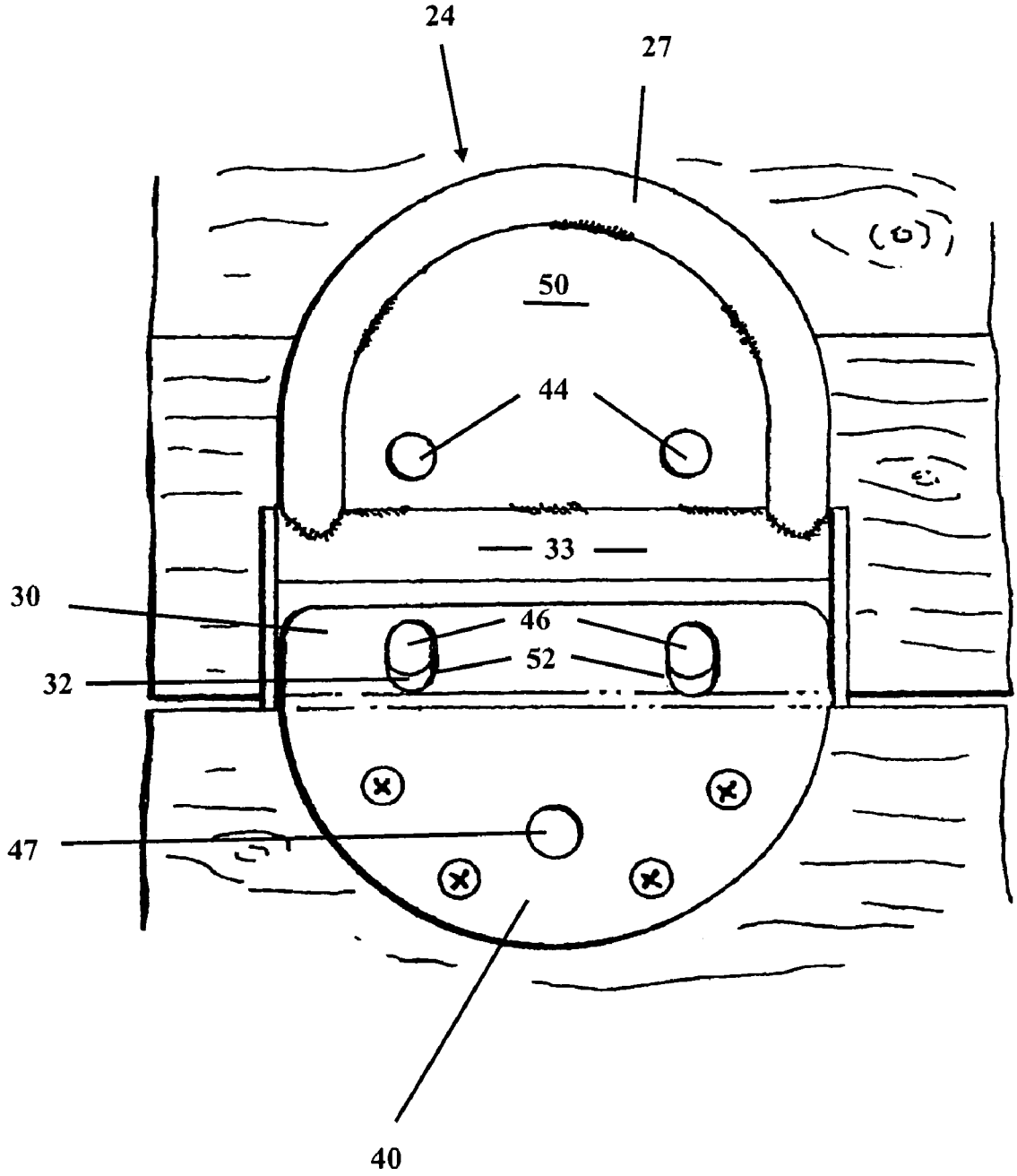
FIG. 8 shows a similar view to FIG. 7 wherein the first part (door jamb) and the second part (door) have been brought together such that the latch plate is positioned ready for engagement with the lock body.

In FIG. 8 the door 22 has been moved to its closed position such that it comes up into close proximity with the door frame and by this relative movement the latch plate 40 has been brought against the base plate 30. In FIGS. 7 and 8 the apertures 52 in the free portion 43 of the latch plate 40 can clearly be seen as can their juxtaposition over the base plate 30.

Movement of the door relative to frame could be by horizontal sliding or by hinging about a side of the door other than the one to which the latch plate 40 is connected. As best seen in FIG. 8, once the door is closed the latch plate comes into position with the free portion 43 overlying the base plate 30. The apertures 52 line up with the holes 46 ready to receive the pegs 44 on the underside of the lock body 24. Rotation of the lock body about the pivot pin can then occur and this will engage the pegs 44 through the apertures 52 and into the holes 46. At this point, as best shown in FIGS. 1, 2 and 3 the lock body 24 overlies the latch plate. As can be seen in FIG. 8 the movement of the latch plate over the base plate covers the screw holes on the base plate. Subsequent closure of the lock body by rotation about the pivot pin covers the latch plate and its fixing points as well as further covering of the fixing points of the base plate. In this way when the lock body is moved to the closed position and the bolt engaged in the keep by operation of the key, all fixings for the device are protected and rotation of the lock body is prevented such that the latch plate cannot be moved from its position. In this way the door cannot be opened in any direction relative to the door frame.

The latch plate 40 shown in FIGS. 7 and 8 is also provided with a hole 47, through which a coach bolt or other fixing can be passed to attach the latch plate to the door. The use of a coach bolt can be advantageous if for any reason the latch plate will be exposed when in the locked configuration. It is possible (although not usual in a configuration of door and frame as shown in FIGS. 7 and 8) for the latch plate to engage with the base plate from the opposite side to that shown in those Figures, i.e. the latch plate will slide laterally between sleeve and the base plate without the preventing their relative movement. In such an arrangement the latch plate would only be partially covered by the lock body when closed so partial access the fixings could be permitted. Coach bolts would prevent this as access to the other side of the part to which the latch plate is attached would be required.

Figure 9:
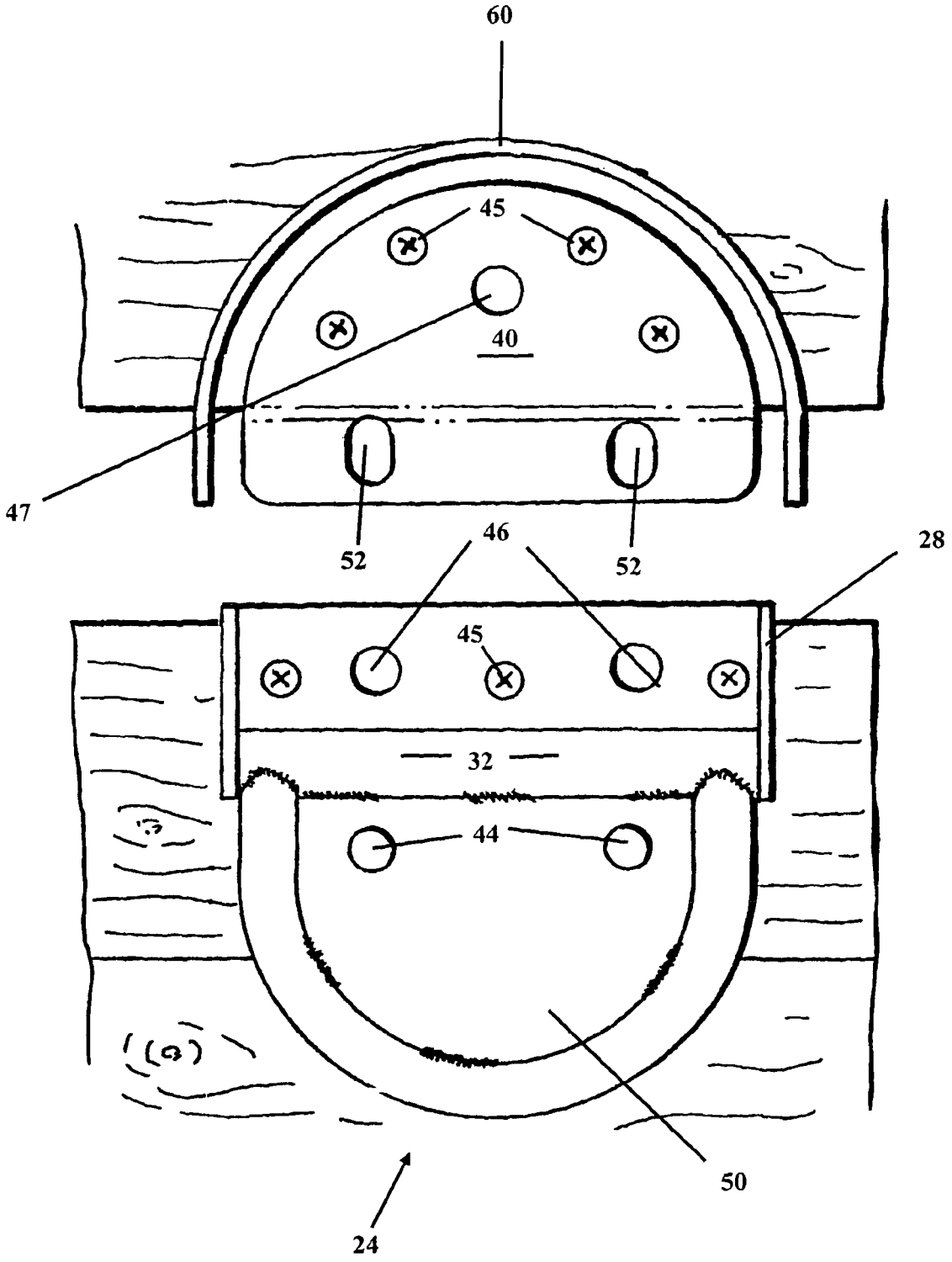
FIG. 9 shows a second embodiment similar to the first embodiment in view similar to FIG. 7, but with a different latch plate.

FIG. 9 shows a very similar second embodiment that is substantially identical to the first one, however there is further provided around the periphery of the main portion 41 of the latch plate 40 an upturned lip 60. This lip reduces the already small possibility of any lever being successfully inserted between the lock body 24 and the surface of the door in an attempt to force the device open. The intrinsic advantages of the design actually allow for a high degree of strength and consequently as long as the lock body in the closed configuration remains close to the latch plate or the second part attempted leverage is unlikely to be unsuccessful, especially given the fact that the present invention allows a very high degree of intrinsic strength to be simply achieved. However provision of such an upturned lip 60 would allow for somewhat lighter weight materials to be used without jeopardizing the intrinsic strength of the product.

Figure 10:
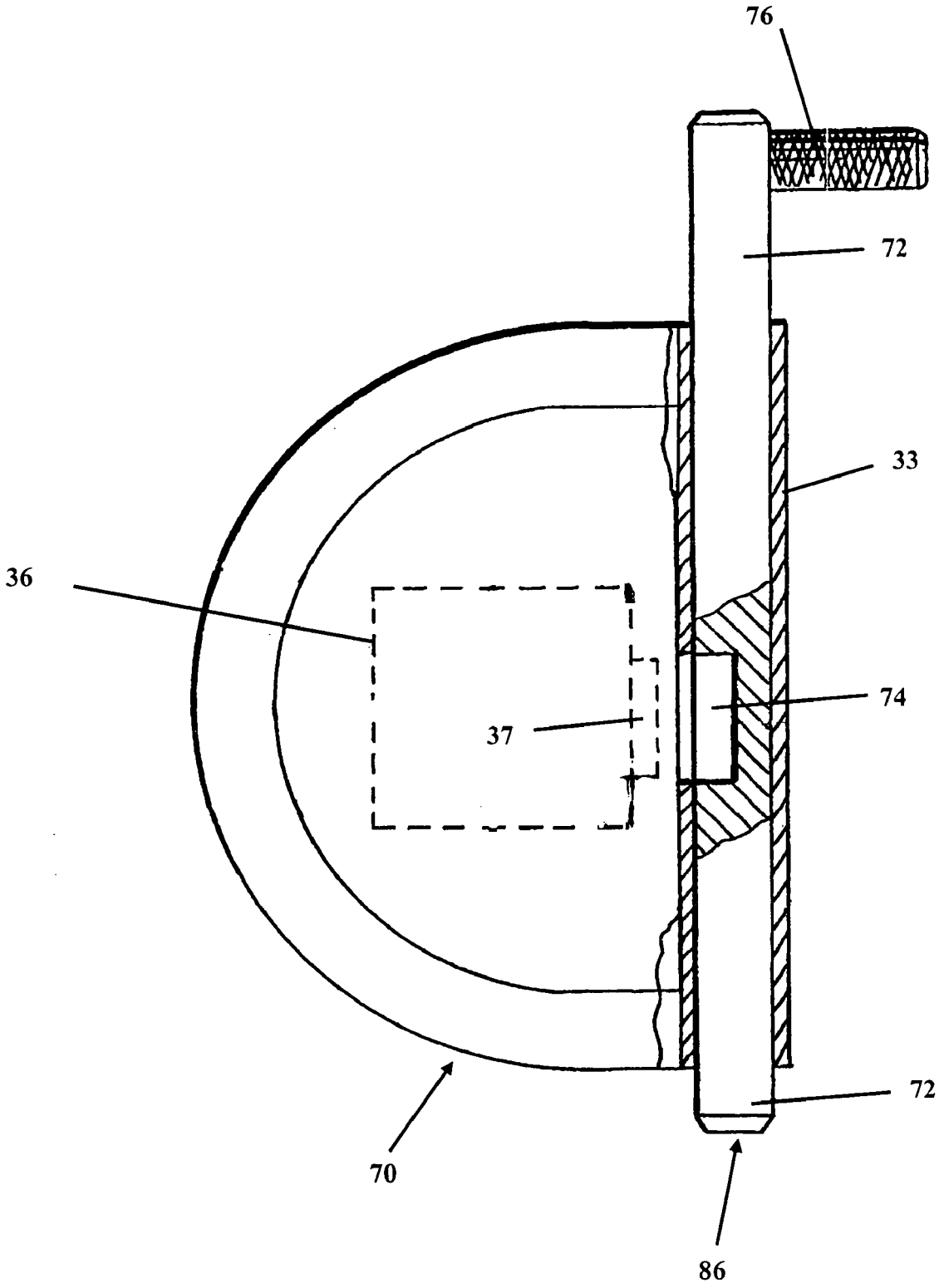
FIG. 10 shows part of an alternative third embodiment in which the pivot pin is able to slide.
Figure 11:
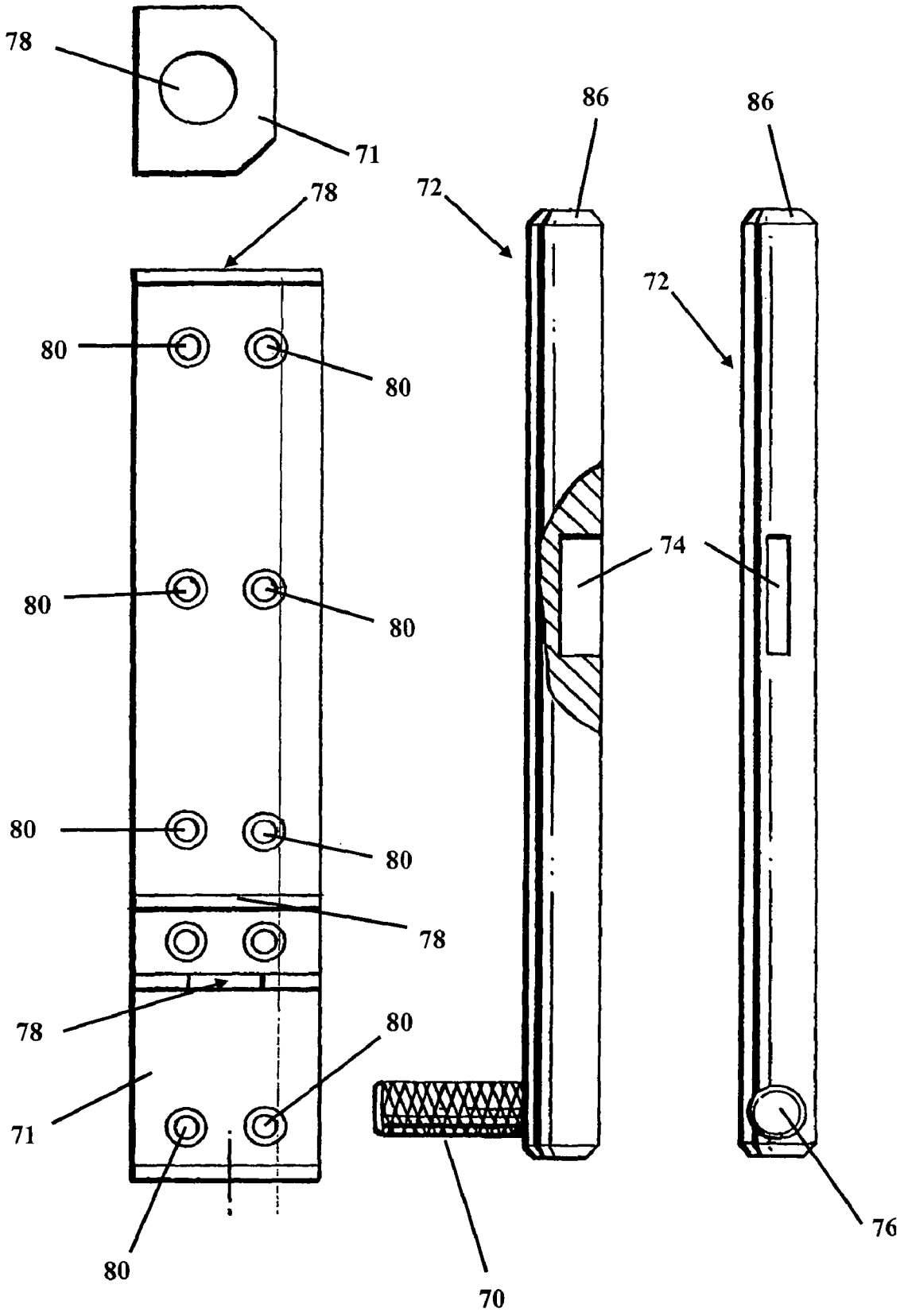
FIG. 11 shows the other constituent parts of such a third embodiment, which would be combined with the lock body and pivot pin as shown in FIG. 10.
Figure 12:
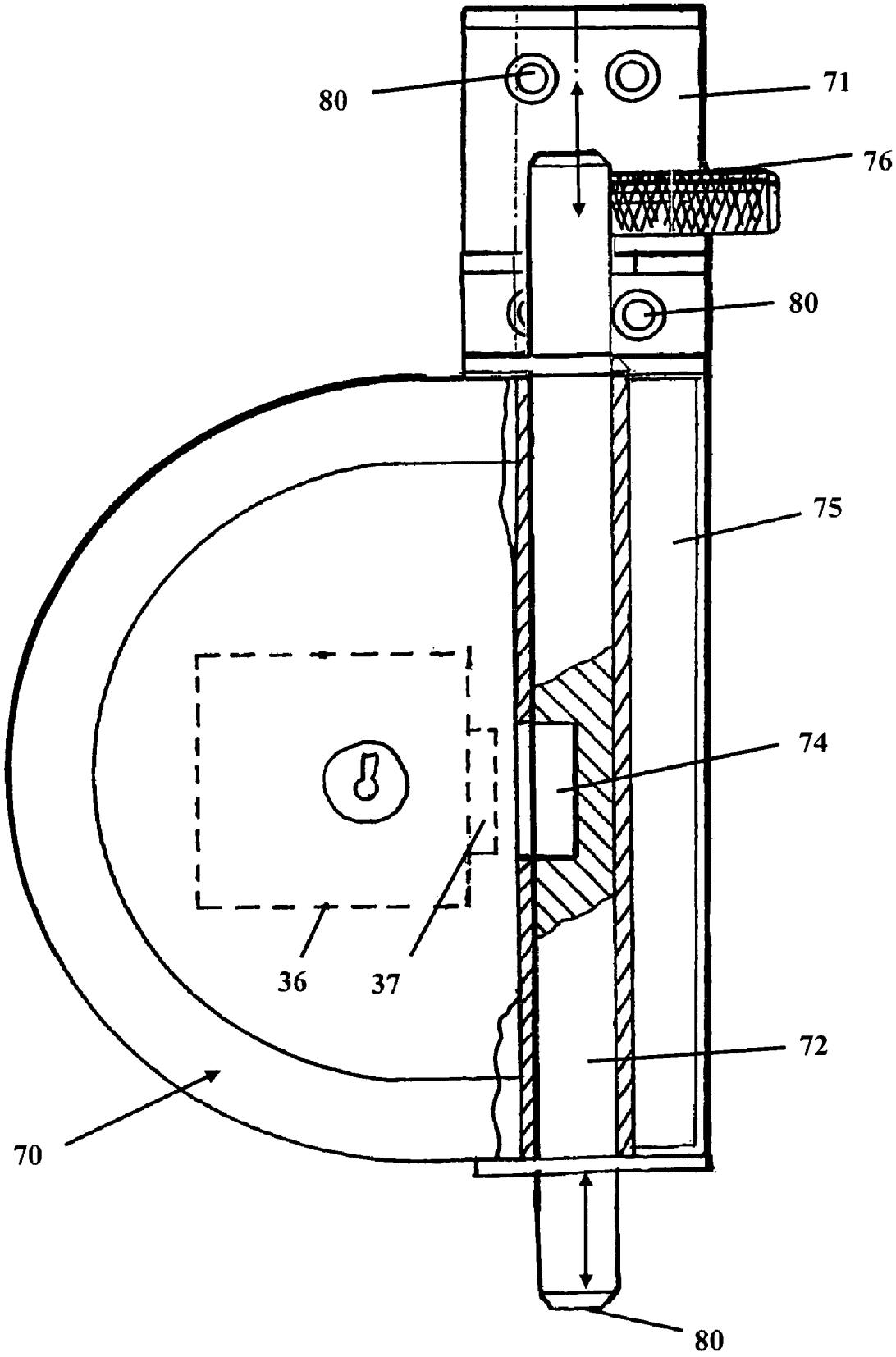
FIG. 12 is a partial cut away view of an assembly of the third embodiment.

FIGS. 10, 11 and 12 show a somewhat different third embodiment in which the lock mechanism has some functional similarity to a conventional sliding bolt arrangement. In this the lock body does not move relative to the base plate but instead the pivot pin moves relative both to the lock body and the base plate (to which the lock body is in fact attached).

As seen in FIG. 10, this third embodiment utilizes a lock body very similar to that provided and described above with one minor alteration. This lock body 70 instead of being provided with pegs on its lower surface in fact is provided with threaded holes such that it may be connected from behind to a backing plate 75 (in FIG. 12) which combination is then connected to the base plate 71 by the pivot pit 72 to prevent relative rotation. The pivot pin 72 is slidably mounted within the channel formed in the lock body 70 and a keep 74 is formed within that pivot pin. The pivot pin 72 is capable of both rotational and longitudinal movement with respect to the lock body 70. A screw threaded handle 76 is connected to one end of the pivot pin 72 such that when not locked the pivot pin may be manually slid. The handle may be removed to permit assembly and disassembly of this embodiment when not locked.

In FIG. 11 there is shown a partially cut away view and a side view of the pivot pin 72 showing the keep 74. There is also shown plan and end views of the elongate base plate 71 which defines circular bolt guides 78 for the pivot bar 72 when assembled. The base plate 71 would be mounted to a first part (not shown) to be locked. The lock body 70 would be connected to the base plate by passing the pivot pin 72 through the bolt guides 78 from one end. As mentioned above the backing plate 75 would prevent rotation of the lock body relative to the base plate about the pivot pin. The threaded handle 76 is then reconnected such that lateral sliding of the bolt from within the channel is prevented. Obviously when locked such sliding is prevented so that removal of the threaded handle will not in those circumstances permit disassembly.

Once all these parts are so assembled in the open configuration with the bolt out of the keep 74 lateral sliding and pivoting of the pivot pin 70 would be permitted such it could be moved to an extended position whereat the free end 86 projects beyond the end of the elongate base plate 71 and engages with a suitable co-operating formation on a second part (neither of which are shown). In this way the pivot pin is operating akin to a conventional sliding bolt arrangement and would engage with the second part in an appropriate way. When in the extended position movement of the mortise bolt into the keep 74 would lock the pivot pin and prevent either its rotation or its sliding movement and hence it would remain in the extended position until the mortise bolt was removed from the keep. The elongate base plate 71 is fixed down using screws passing through screw holes 80. Mounting (as shown in FIG. 12) of the lock body and attached backing plate one the base plate covers at least some of these and prevents tampering.

In addition to the embodiment shown and described above it is also possible for the present invention to take the form of a hinge in which the pivot 30 pin forms the hinge or is co-axial with other hinges. In this way locking of the lock body relative to base plate would actually prevent rotation of the hinged part relative to the fixed part. For example on a chest a mechanism such as the present invention could be provided either to lock the opening edge of the lid to the remainder as described above or it could be used to lock the hinge in such a way that the movement was prevented and consequently opening was not permitted.

Most if not all of the constituent parts of the present invention described above could and preferably would be formed from materials having a high degree of strength. Clearly for this purpose metals such as steel are particularly advantageous as they permit a high degree of strength in the components. This in addition to the features of the present invention (which minimizes potential for attack by undoing fixings, by levering or cutting the material itself) will allow it to be sufficiently strong to resist other forms of attack such as sawing or heat/chemical cutting.

The invention claimed is:

1. A lock mechanism to lock a first part and a second part relative to each other, said lock mechanism having a closed configuration and a open configuration, and said lock mechanism comprising:

a base plate attachable to the first part;

a pivot pin secured to the base plate, to prevent movement with respect thereto and having an axis of rotation substantially parallel to the base plate;

a keep defined in the pivot pin;

a lock body defining a channel within which the pivot pin is located, said lock body mounted for rotation around the pivot pin and with respect to the base plate, to move between the open and closed configurations; and a locking arrangement located within the lock body, said locking arrangement including a bolt movable between an extended position and a retracted position, whereby in the closed configuration the lock body and pivot pin are suitably positioned relative to each other such that the bolt may be moved by the locking arrangement to the extended position so as to engage the keep and thus prevent rotation of the lock body relative to the pivot pin, whereas in the open configuration the lock body and pin are not suitably positioned to enable the bolt to engage the keep.

2. A lock mechanism as claimed in claim 1, wherein the channel in the lock body is defined by a tubular sleeve which is located substantially to one side of the lock body, with the remainder of the lock body extending radially with respect to the sleeve, the sleeve having formed therein an aperture suitable to permit the movement of the bolt therethrough for engagement with the keep.

3. A lock mechanism as claimed in claim 2, wherein, in addition to the sleeve, the lock body comprises a curved bar, both ends of which are joined to spaced parts of the sleeve, a front cover plate which is arranged on one face of the sleeve and the curved bar, and a rear cover plate similarly arranged on the opposite face of the sleeve and curved bar, the sleeve, bar, front plate and rear plate together defining a lock chamber within which the locking arrangement is located.

4. A lock mechanism as claimed in claim 1 wherein the lock body is substantially D-shaped.

5. A lock mechanism as claimed in claim 1, wherein the base plate has two regions, which are formed at substantially a right angle to each other, and which is adapted to connect to the edge of the first part to be locked.

6. A lock mechanism as claimed in claim 1, wherein in the closed configuration the lock body overlies and obstructs the movement of the second part to be locked relative to the first part.

7. A lock mechanism as claimed in claim 1, wherein there is further provided a separate latch plate that is attachable to the second part and which may be brought in to proximity with the base plate when the first and second parts are suitably positioned relative to each other, and which latch plate may be held in close proximity with the base plate by the lock body when the lock body is in the closed configuration.

8. A lock mechanism as claimed in claim 1, wherein the lock body is provided with one or more pegs that locate within a cooperating female part in the base plate when the lock body is in its closed configuration.

9. A lock mechanism as claimed in claim 7, wherein there is provided one or more pegs on the lock body and a corresponding number of female parts on the base plate and holes in the latch plate, such that in the closed configuration the or each peg passes through the or each hole in the latch plate and into the or each female part on the base plate, thereby preventing relative movement of the base plate and latch plate.

10. A lock mechanism as claimed in claim 1, wherein the locking arrangement is actuated by a key.

11. A lock mechanism as claimed in claim 1, wherein the means by which the base plate is attached to the first part are concealed by the lock body when in the closed configuration.

12. A lock mechanism as claimed in claim 1, wherein the means of attachment of the base plate are fixings that pass through suitable screw holes in the base plate, and the heads of those fixings are covered by the lock body when in its closed configuration.

13. A lock mechanism as claimed in claim 1, which is adapted to form part of a hinge mechanism between the first part and the second part, with the pivot pin being coaxial with the axis of hinging, and in the closed configuration the relative hinging movement of the first and second parts is prevented.

14. A lock mechanism as claimed in claim 1, wherein the second part is a door or lid, and the first part is a frame for that door or lid or is a second door adjacent thereto.

15. A lock mechanism as claimed in claim 7, wherein the means by which the latch plate is attached to the second part are concealed by the lock body when in the closed configuration.

16. A lock mechanism as claimed in claim 7, wherein the means of attachment of the latch plate are fixings that pass through suitable screw holes in the latch plate, the fixings having heads which are covered by the lock body when in its closed configuration.

* * * * *